United States Patent [19]

Ogura et al.

[11] Patent Number: 4,586,220

[45] Date of Patent: May 6, 1986

[54] SEPARABLE SLIDE FASTENER

[75] Inventors: Toyosaku Ogura; Seiji Nishino, both of Kurobe, Japan

[73] Assignee: Yoshida Kogyo K. K., Tokyo, Japan

[21] Appl. No.: 712,146

[22] Filed: Mar. 15, 1985

[30] Foreign Application Priority Data

Mar. 15, 1984 [JP] Japan ..... 59-50098

[51] Int. Cl.[4] ..... A44B 19/36

[52] U.S. Cl. ..... 24/433; 24/434

[58] Field of Search ..... 24/433, 434

[56] References Cited

U.S. PATENT DOCUMENTS

| | | | |
|---|---|---|---|
| 2,193,833 | 3/1940 | Morin et al. | 24/434 |
| 2,655,704 | 10/1953 | Simpson | 24/433 |
| 2,814,847 | 12/1957 | Zbinden | 24/434 |
| 3,435,489 | 4/1969 | Morin | 24/434 |
| 4,459,723 | 7/1984 | Takano et al. | 24/433 X |

FOREIGN PATENT DOCUMENTS

| | | | |
|---|---|---|---|
| 46702 | 2/1967 | France | 24/434 |
| 2099499 | 12/1982 | United Kingdom | 24/433 |

*Primary Examiner*—William E. Lyddane

*Assistant Examiner*—Peter A. Aschenbrenner

*Attorney, Agent, or Firm*—Hill, Van Santen, Steadman & Simpson

[57] ABSTRACT

A separable terminal assembly of a separable slide fastener includes a separable pin mounted on one stringer tape along one longitudinal edge thereof, the separable pin including a pair of plates interconnected at one longitudinal edge and disposed one on each side of the stringer tape. Each of the plates has a flange extending along the other longitudinal edge of the plate and a bevelled upper end wall held in abutting engagement with the endmost coupling element disposed next to the separable pin. The bevelled upper end walls slope down in a direction from the one toward the other longitudinal edge of each plate. The flanges terminate short of the respective bevelled upper end walls so as to define between the plates and the flanges a pair of openings for allowing the one longitudinal tape edge to flex laterally toward the other longitudinal edge of the stringer tape while the endmost coupling element passes through a branch of the Y-shaped guide channel in a slider. The separable pin thus constructed can easily be inserted into and removed from a mating retainer without special manipulation.

5 Claims, 8 Drawing Figures

SEPARABLE SLIDE FASTENER

BACKGROUND OF THE INVENTION

1. Field of the Invention

The present invention relates to a slide fastener and more particularly to a separable type of slide fastener having a separable terminal assembly.

2. Prior Art

A separable terminal assembly (normally referred to as separable bottom end stop) of a separable slide fastener comprises a box-like retainer or socket mounted on one stringer tape at one end thereof, and a separable pin mounted on the other stringer tape at one end thereof and releasably engageable with the socket for interconnecting the two stringer tapes. The separable pin is of a generally tube-like element and normally separated by configuration into two types, one being a substantially straight or slightly curved separable pin and the other being a doglegged or angularly bent separable pin.

A disadvantage of the substantially straight separable pin proposed heretofore lies in the difficulty of its insertion into and extraction from a mating socket with a slider positioned next to the separable terminal assembly. A muscular effort is necessary since the straight pin, as is moved along a bent channel defined jointly by the slider and the socket, abuts against interior walls of the slider and the socket. The doglegged separable pin is disadvantageous in that while the pin is inserted into or removed from the socket through the slider, a corner portion of its dogleg shape impinges against the interior walls of the slider, thus hindering a smooth movement of the pin. Further, the doglegged separable pin is likely to accidentally separate from the socket when a pull in opposite directions is exerted on the stringer tapes. For production, the doglegged pin requires a bending process which would cause the difficulty of reducing the manfacturing cost and maintaining a uniform quality in mass production. A drawback common to both types of separable pin is in that during insertion and removal of the separable pin, the endmost coupling element located next to the separable pin is thrusted by the sidewall of a slider's guide post, in a lateral direction away from the slider. The stringer tape tends to become ruptured at its longitudinal edge that has been stretched by such thrusted endmost coupling element, rendering the fastener useless.

SUMMARY OF THE INVENTION

It is therefore an object of the present invention to provide an improved separable slide fastener which will eliminate the above-noted difficulties of the prior art devices.

A more specific object of the present invention is to provide a separable slide fastener including a separable terminal assembly which is so constructed as to allow smooth engagement and disengagement of a separable pin with respect to a mating retainer, and to prevent a splitting of the meshing coupling elements due to an accidental rupture of a stringer tape.

Another object of the present invention is to provide a separable slide fastener with a separable terminal assembly having a separable pin which is simple in construction and hence can be manufactured less costly by mass production, and which can be retained stably and securely in position on a stringer tape against accidental withdrawal from a mating retainer under lateral pulling forces.

According to the present invention, a separable slide fastener includes a separable terminal assembly mounted on lower ends of two stringer tapes at lower ends of two rows of coupling elements for interconnecting or separating the two stringer tapes. A separable pin of the separable terminal assembly is mounted on one stringer tape over one longitudinal edge thereof and includes a pair of substantially rectangular plates disposed one on each side of the one stringer tape and interconnected at respective one longitudinal edges. Each of the plates has a flange on the other longitudinal edge thereof engaging the stringer tape, and a bevelled upper end wall held in abutting engagement with the endmost coupling element and sloping down in a direction from the one toward the other longitudinal edge of the plate at an angle to a line transverse to the slide fastener. The longitudinal flanges terminate short of the bevelled upper end walls of the respective plates so as to provide a pair of openings. With the openings thus provided, the longitudinal tape edge is allowed to flex in a lateral direction toward the other longitudinal edge of the stringer tape when a lateral thrust is exerted to the stringer tape in response to abuttment of the endmost coupling element against the guide post of a slider.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
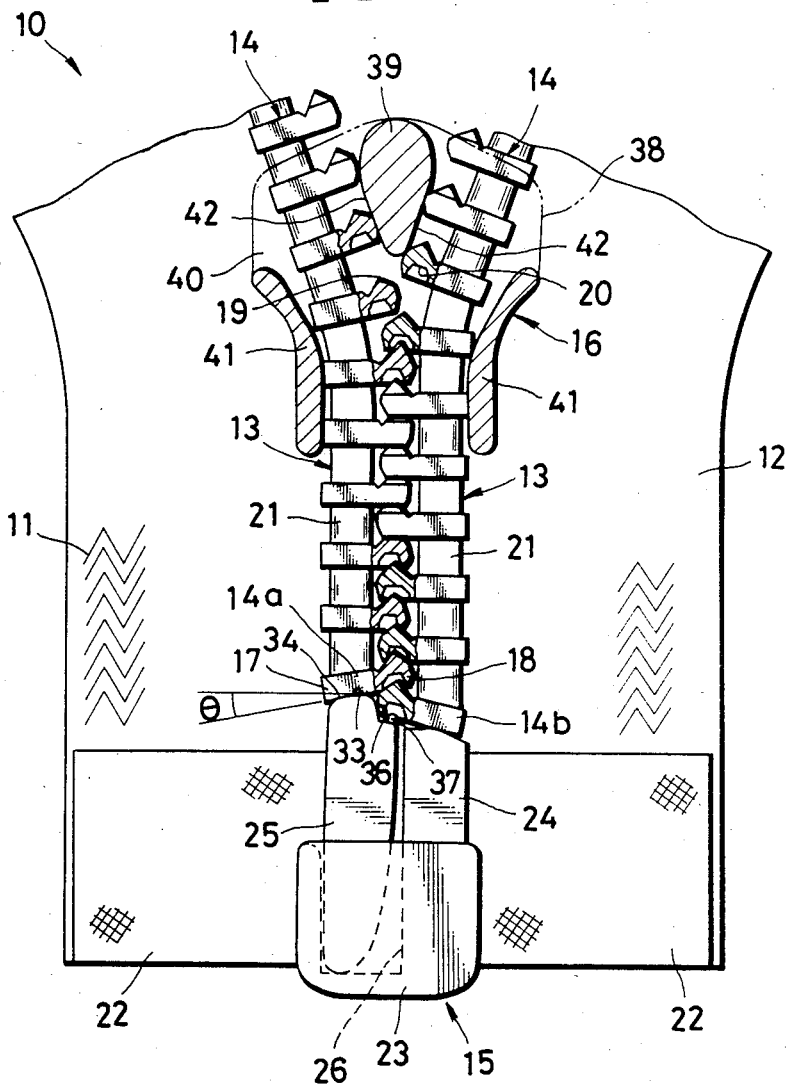
FIG. 1 is a plan view, partly in cross section, of a portion of a separable slide fastener according to the present invention.

As shown in FIG. 1, a separable slide fastener 10 generally comprises a pair of stringer tapes 11, 12 each carrying on and along its one longitudinal edge 13 a row of discrete coupling elements 14, a separable terminal assembly 15 mounted on lower ends of the stringer tapes 11, 12 at a lower end of the rows of coupling elements 14, 14, and a slider 16 slidably mounted on the rows of coupling elements 14, 14 for taking them into and out of interdigitating engagement with each other to close and open the separable slide fastener 10.

Figure 3:
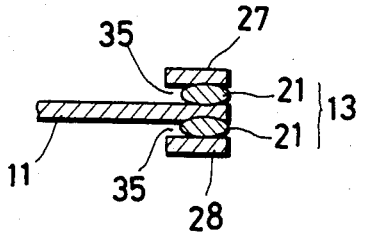
FIG. 3 is a cross-sectional view taken along line III—III of FIG. 2.
Figure 4:
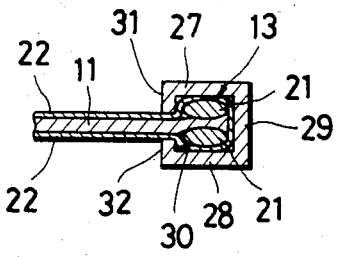
FIG. 4 is a cross-sectional view taken along line IV—IV of FIG. 2.
Figure 5:
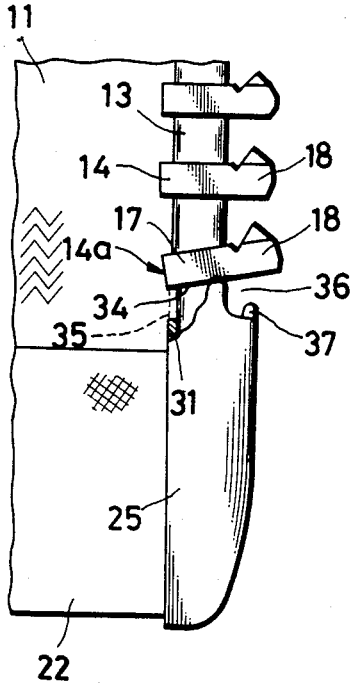
FIG. 5 is a plan view, partly broken away for clarity, of FIG. 2.

Each of the coupling elements 14 has a bifurcated leg portion 17 mounted astride the longitudinal tape edge 13, and a coupling head portion 18 projecting from the leg 17 transversely beyond the longitudinal tape edge 13. The coupling head 18 includes a lateral projection 19 and an opposite recess or pocket 20 for receiving the projection 19 of an adjacent coupling element 14. The longitudinal tape edge 13 is beaded or enlarged in cross section as it includes, as shown in FIGS. 3 and 4, a pair of reinforcing cords or stuffer warps 21, 21 disposed one on each surface of the stringer tape 11, 12. The reinforcing cords 21, 21 are united with the tape 11, 12 during the formation of the tape 11, 12. A pair of reinforcing films 22, 22 is mounted on the stringer tapes 11, 12, respectively, at the lower ends thereof. Each of the reinforcing films 22, 22 overlies the beaded longitudinal edge 13 of a corresponding one of the stringer tapes 11, 12 and extends substantially the entire width of each surface of the stringer tape 11, 12.

The separable terminal assembly 15 includes a box-shaped retainer or socket 23 and a retainer pin 24 extending therefrom, the retainer 23 and the retainer pin 24 being secured by clinching to the lower end of the stringer tape 12 along the beaded longitudinal edge 13 thereof, and a substantially straight separable pin 25 secured by clinching to the lower end of the stringer tape 11 along the beaded longitudinal edge 13 thereof and receivable in a longitudinal opening 26 in the retainer 23.

Figure 2:
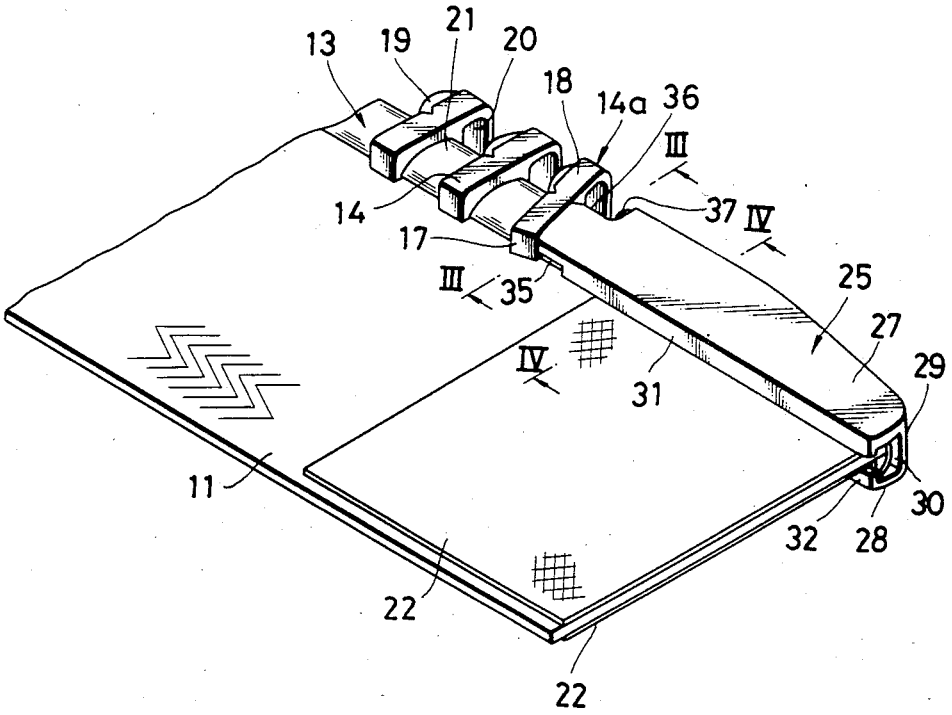
FIG. 2 is an enlarged perspective view of a left half of the separable slide fastener shown in FIG. 1.
Figure 6:
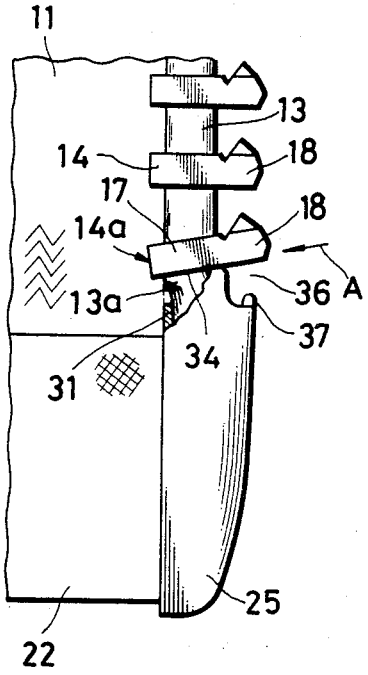
FIG. 6 is a view similar to FIG. 5, showing a stringer tape as flexed in a lateral direction.

As shown in FIG. 2, the separable pin 25 has a generally C-shaped cross section and includes a pair of substantially rectangular front and rear plates 27, 28 interconnected at one edge by a sidewall 29 to define therebetween a longitudinal groove 30 for receiving therein the beaded longitudinal edge 13 and the reinforcing film 22 that are located at the lower end of the stringer tape 11. The front and rear plates 27, 28 have, at the respective other edges, a pair of longitudinal flanges 31, 32 extending toward one another. Each of the front and rear plates 27, 28 has a bevelled upper end wall (FIG. 1) extending obliquely across the beaded longitudinal edge 13 of the stringer tape 11 and sloping down in a direction from the one edge to the other edge of the plate 27, 28 at an angle $\theta$ (FIG. 1) to a line perpendicular to the separable slide fastener 10. The bevelled upper end walls 33 of the separable pin 25 are held in abutting engagement with a sidewall 34 of the leg portion 17 of the endmost coupling element **14*a* so that the longitudinal axis of the endmost coupling element 14*a* tilts downwardly away from the longitudinal axis of the second endmost coupling element 14 at the angle $\theta$. The longitudinal flanges 31, 32 of the separable pin 25 extend from lower ends of the plates 27, 28 toward the upper end walls 33 and terminate short of the upper end walls 33 so as to define a pair of openings 35, 35 between the ends of the flanges 31, 32 and the plates 27, 28, respectively. With the openings 35, 35 thus provided, the longitudinal edge 13 is allowed to flex, as shown at 13*a* in FIG. 6, in a lateral direction toward the other longitudinal edge of the stringer tape 11 when the endmost coupling element 14*a* is subjected to a lateral thrust applied in the direction of the arrow A during engagement or disengagement of the separable pin 25 with the retainer 23**.

The separable pin 25 also has a recessed portion 36 disposed adjacent to the coupling head portion 18 of the endmost coupling element **14*a*, for receiving therein the coupling head portion 18 of the endmost coupling element 14*b* disposed next to the retainer pin 24. The sidewall 29 has on its upper end an auxiliary projection 37 extending into the recess 36 in alignment with the pocket 20 of the endmost coupling element 14*a*. The projection 37 is receivable in the pocket 20 of the endmost coupling element 14*b* when the slide fastener 10** is closed.

The slider 16 is of a conventional construction and includes a pair of parallel spaced wings 38 (one wing being omitted for clarity) joined at their one end with a neck or guide post 39 so as to define a substantially Y-shaped guide channel 40 for the passage therethrough of the rows of coupling elements 14, 14. Each of the wings 38 has on its opposite side edges a pair of longitudinal guide flanges 41, 41 projecting toward the opposed wing and terminating short of the latter for the entry of the stringer tape 11, 12. The guide post 39 has a substantially wedge-shaped cross section and includes opposite sidewalls 42, 42 extending convergently toward the other end of each wing 38 for guiding the coupling head portions 18 of the rows of coupling elements when they are coupled and uncoupled together. Each of the sidewalls 42 slopes at an angle to a longitudinal central axis common to the slider 16 and the slide fastener 10 such that the longitudinal axis of the endmost coupling element **14*a* extends at a right angle (FIG. 7) to one sidewall 42 engageable with the endmost coupling element 14*a*. That is to say, the angle of inclination of the one wall 42 is the same as the tilting angle $\theta$ of the endmost coupling element 14*a***.

Figure 7:
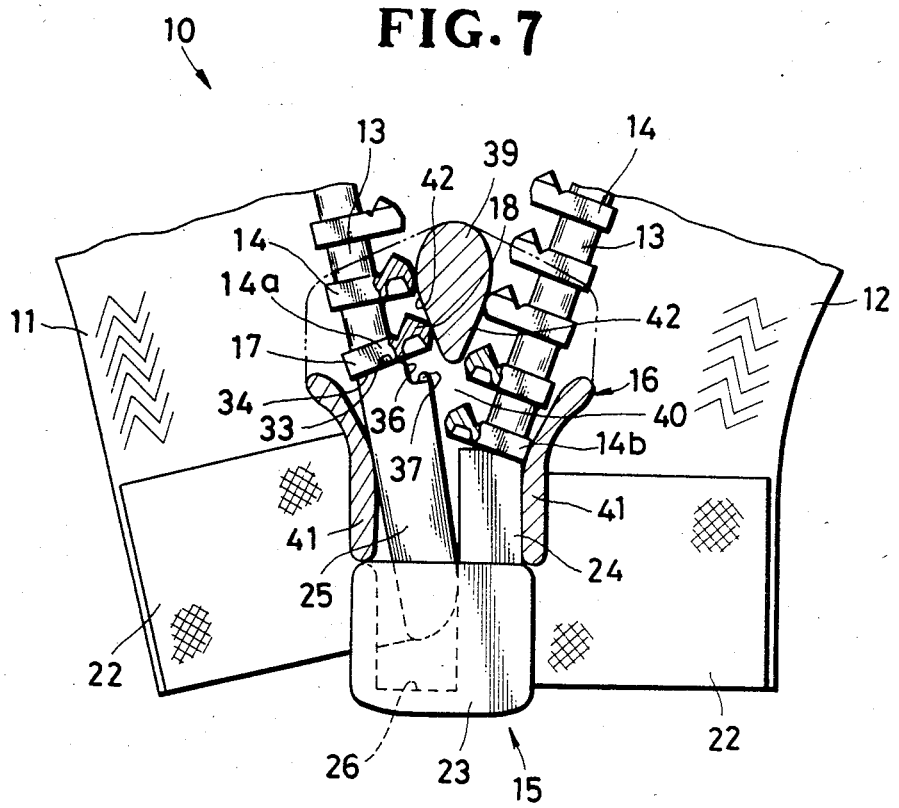
FIGS. 7 and 8 are fragmentary plan views, partly in cross section, of the separable slide fastener, showing successive movements of two stringer tapes as they are brought into lateral alignment with each other.
Figure 8:
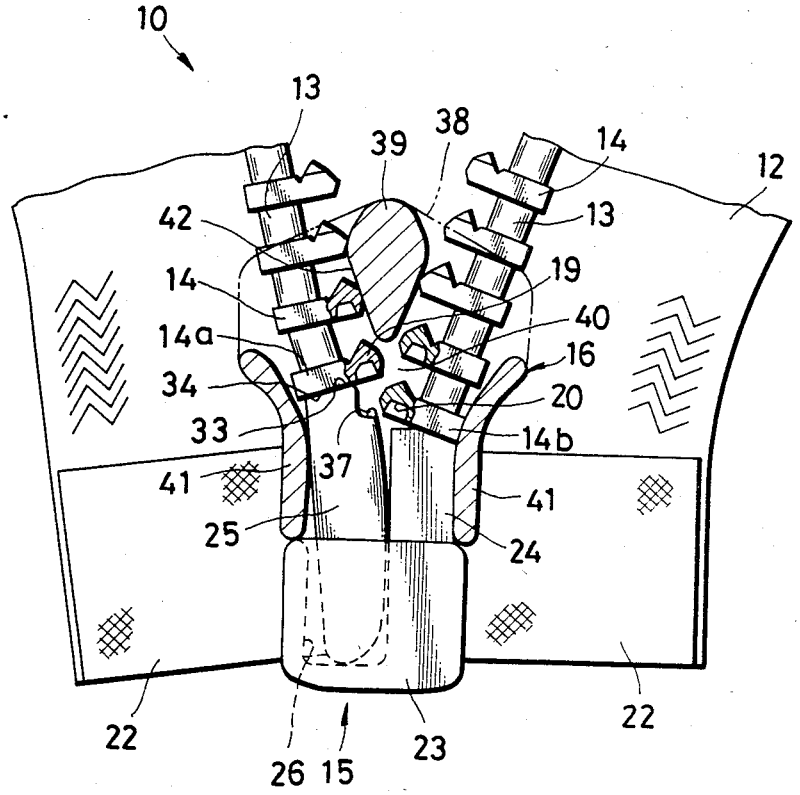

Operation of the separable slide fastener 10 is described below. When the stringer tapes 11, 12 are to be interconnected as shown in FIG. 1, the separable pin 25 is inserted, in such a manner as shown in FIGS. 7 and 8, into the opening 26 in the retainer 23 through the Y-shaped guide channel 40 in the slider 16 with the latter positioned next to the retainer 23. During that time, the endmost coupling element **14*a* is forced to displace laterally outwardly from the slider 16. However, partly because of the tilted arrangement of the endmost coupling element 14*a* and partly because of the openings 35 in the separable pin 25, the longitudinal tape edge 13 is allowed to flex for taking up or cancelling out the laterally thrusting force applied on the endmost coupling element 14*a* by the guide post 39 of the slider 16. Thus the endmost coupling element 14*a* can pass through a branch of the Y-shaped guide channel 40 while being guided between one sidewall 42 of the guide post 39 and the guide flanges 41 of the slider 16. With the slide fastener 10 thus constructed, the separable pin 25 can be smoothly brought into and out of engagement with the retainer 23 without special manipulation. Thus the stringer tape 11 is free from rupture at the longitudinal edge 13 which could otherwise occur when the endmost coupling element 14*a* is laterally displaced in the slider 16 to stretch the longitudinal tape edge 13. Then the slider 16 is moved upwardly in a fastener closing direction for interdigitating the rows of the coupling elements 14, 14. As shown in FIG. 1, the auxiliary projection 37 is received in the pocket 20 in the endmost coupling element 14*b* so as to prevent substantial reduction of coupling strength of the intermeshing rows of coupling elements at a portion adjacent to the tilted endmost coupling elements 14*a*, 14*b*. Removal of the retainer pin 25 from the retainer 23** can smoothly be accomplished in the reverse order of the just mentioned insertion.

As the retainer pin 25 is a substantially straight tubular element it therefore is easy to manufacture in mass production; it is attachable to the stringer tape 11 with utmost ease and can be stably held in position against displacement from the retainer 23.

The retainer 23 in the illustrated embodiment is integral with the retainer pin 24 and fixed to the longitudinal tape edge 13. However, according to the invention, the separable terminal assembly 15 may include a movable retainer (not shown) which is movably mounted on one stringer tape and slidable along the rows of coupling elements to permit separation of the two stringer tapes from the lower end, without the necessity of opening the slide fastener from the upper end. The movable retainer also performs a similar function to that of the fixed retainer 23 and is not removable from the lower end of the slide fastener.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A separable slide fastener comprising:

(a) a pair of stringer tapes each carring on its one longitudinal edge a row of coupling elements, each said coupling element having a bifurcated leg portion mounted astride said one longitudinal edge and a coupling head portion projecting transversely beyond said longitudinal edge;

(b) a slider slidably mounted on said rows of coupling elements for taking them into and out of interdigitating engagement with each other to close and open the slide fastener;

(c) a separable terminal assembly comprising a retainer mounted on one of said stringer tapes at one end thereof, and a separable pin mounted on the other stringer tape at one end thereof and releasably engageable with said retainer, said separable pin having a pair of plates disposed one on each side of said other stringer tape and interconnected at respective one longitudinal edges, each said plate having on the other longitudinal edge thereof a flange engaging said other stringer tape and an end wall held in abutting engagement with the endmost coupling element located next to said separable pin; and (d) said end wall sloping down in a direction from said one longitudinal edge of said plate toward said other longitudinal edge of the same so that said endmost coupling element tilts in a direction away from the next adjacent coupling element, said flanges terminating short of said sloped end walls of said plates so as to define therebetween a pair of openings for allowing said one longitudinal edge of said other stringer tape to flex laterally toward the other longitudinal edge of said other stringer tape.

2. A separable slide fastener according to claim 1, said coupling head including a lateral projection and an opposite pocket, said separable pin further having a sidewall interconnecting said plates along said one edges thereof, and a recessed portion adjacent to said coupling head of said endmost coupling element, said sidewall having an auxiliary projection extending into said recessed portion and receivable into said pocket in the endmost coupling element on said one stringer tape.

3. A separable slide fastener according to claim 1, said one longitudinal edge of each said stringer tape including a pair of reinforcing cords disposed one on each side of said stringer tape and united with said stringer tape.

4. A separable slide fastener according to claim 1, said endmost coupling element tilting at an angle to a line perpendicular to the longitudinal central axis of the slide fastener, said slider including a pair of spaced wings joined at one end with a guide post so as to define between said wings a substantially Y-shaped guide channel for the passage of said rows of coupling elements, said guide post having opposite sidewalls converging toward the other end of said wings, one of said sidewalls, which is engageable with said endmost coupling element, sloping at said angle with respect to the longitudinal axis of said slider.

5. A separable slide fastener according to claim 1, said separable terminal assembly including a retainer pin integral with and extending from said retainer, said retainer pin and said retainer being fixed to said one stringer tape.

* * * * *